US008449314B1

(12) United States Patent
Feist et al.

(10) Patent No.: US 8,449,314 B1
(45) Date of Patent: May 28, 2013

(54) LATCHING SYSTEM FOR ELECTRICAL CONNECTOR

(75) Inventors: Jeremiah Feist, Minnespolis, MN (US); Andrew Strange, Arden Hills, MN (US)

(73) Assignee: Omnetics Connector Corporation, Minneapolis, MN (US)

( * ) Notice: Subject to any disclaimer, the term of this patent is extended or adjusted under 35 U.S.C. 154(b) by 0 days.

(21) Appl. No.: 13/195,134

(22) Filed: Aug. 1, 2011

Related U.S. Application Data

(60) Provisional application No. 61/425,991, filed on Dec. 22, 2010.

(51) Int. Cl.
*H01R 13/627* (2006.01)

(52) U.S. Cl.
CPC ..... *H01R 13/6275* (2013.01)
USPC ..... 439/358

(58) Field of Classification Search
USPC ..... 439/358, 357, 362, 638, 701, 717, 439/283, 352, 641, 643, 648
See application file for complete search history.

(56) References Cited

U.S. PATENT DOCUMENTS

| | | | | |
|---|---|---|---|---|
| 4,921,442 | A * | 5/1990 | Puerner | 439/499 |
| 5,298,683 | A * | 3/1994 | Taylor | 174/152 GM |
| 6,799,981 | B1 * | 10/2004 | Yu | 439/133 |
| 2006/0094281 | A1 * | 5/2006 | Dang | 439/352 |
| 2010/0285682 | A1 | 11/2010 | Wu | |

* cited by examiner

*Primary Examiner* — Renee Luebke
*Assistant Examiner* — Harshad Patel
(74) *Attorney, Agent, or Firm* — Elizabeth D. Lewen; Sherrill Law Offices, PLLC

(57) ABSTRACT

An electrical connector latching system for latching to and releasing from a receiving connector quickly and conveniently in a small space without damage to the receiving connector from misalignment of the connectors. The latching system has a first connector end and a second connector end, the first end having a pair of slots formed on the sides thereof, each slot having an aperture at the interior end of the slot and a second connector end having a pair of spring-mounted latching arms attached on the sides, each latching arm having a tooth with a lead-in ramp formed in the distal end thereof, the tooth received by the slot and ultimately by the aperture formed in the first connector end as the spring mounted in the pivoting latching arms urges the arms to latch as the two connector ends are manually pushed together. An adapter plate permits retro-fitting of the latching system to a standard connector.

3 Claims, 5 Drawing Sheets

LATCHING SYSTEM FOR ELECTRICAL CONNECTOR

This application claims the benefit of U.S. Provisional Application No. 61/425,991, filed Dec. 22, 2010.

BACKGROUND

This application relates to electrical connectors. Specifically, it is directed to a latching system for mated type electrical connectors.

A microminiature rectangular electrical connector having a polarized shell commonly referred to as "Micro-D" electrical connector, is a common type of connector. It is called a D type connector because of its D-shaped metal shield that gives mechanical support, orientation, alignment and some screening against electromagnetic interference. Its small size enables its use in areas of limited space. The Micro-D electrical connector comes as a two-piece connector, the male connector end typically contains pin contacts and the female connector end typically has socket contacts. The male connector pin contacts shield fits tightly inside the female connector socket end shield when the two connector ends are mated together. Providing a secure connection has in the past been provided by a jackscrew system that requires jackpost housing to receive the jackscrews, and tools for fastening the jackscrews. Clearance around the connector is required for these tools to be used. Additionally, the fastening of these connectors with jackscrews is time consuming. Also, uneven tightening of these jackscrews can result in expensive damage to the contacts. A need exists in the art for a connector fastening system that can be accomplished quickly, without the need for tools and their clearance needs, and prevents damage to contacts from the uneven tightening of jackscrews. A need further exists to be able to retro-fit standard connectors with the new latching system.

SUMMARY OF THE INVENTION

The need in the art is addressed by an improved electrical connector assembly with an improved latching system for latching to and releasing from a receiving connector quickly and conveniently in a small space and without damage to the receiving connector from misalignment of the connectors.

Applicant has invented an electrical connector latching system for connecting a pair of electrical connectors that comprises a first connector end and a second connector end, the first end having a pair of slots formed on the sides thereof, each slot having an aperture at the interior end of the slot and a second connector end having a pair of spring-mounted latch arms attached on the sides, each arm having a tooth with a lead-in ramp formed in the distal end thereof, the tooth received by the slot and ultimately by an aperture formed in the first connector end as the spring mounted in the pivoting arms urges the arms to latch.

An electrical connector latching system as above, further comprising an adapter plate having a pair of slots formed on sides thereof, each slot having an aperture at the interior end of the slot, the adapter plate mounted on a standard connector first end to adapt the standard connector first end to receive the latch mounted on the second connector end of the device of this invention.

An electrical connector latching system as above, further comprising a tool-free latching system for a two-piece electrical connector, for connecting a first connector end and a second connector end, the first end having a pair of slots formed on the sides thereof, each slot having an aperture at the interior end of the slot and a pair of spring-mounted arms attached on the sides of the second connector end, each arm having a tooth, the tooth having a lead-in ramp formed in the distal end thereof, the tooth guided by the slot and received by an aperture formed in the first connector end as the spring mounted in the latch arms urges the arms to latch.

An electrical connector having a tool-free latching system as above, further comprising an adapter plate having a pair of slots formed on the sides thereof, each slot having an aperture at the interior end of the slot, the adapter plate mounted on a standard connector first end to adapt the standard connector first end to receive the latch mounted on the second connector end of the device of this invention.

DETAILED DESCRIPTION OF A PREFERRED EMBODIMENT

Nomenclature

Figure 1A:
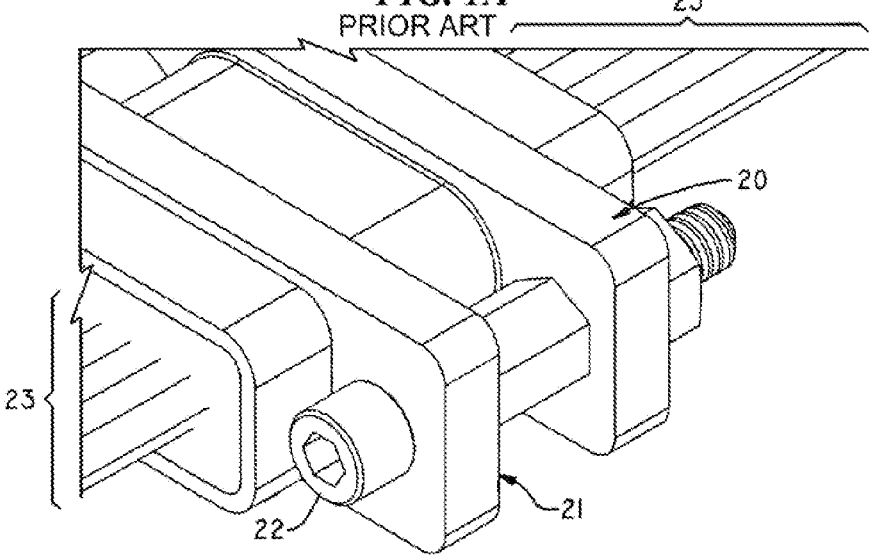
FIG. 1A PRIOR ART
FIG. 1A is a fragmentary perspective view of the prior art Micro-D type electrical connector in the closed position.

10 Apparatus Generally
11 1st Connector End
12 Slot
13 Aperture
14 2nd Connector End
15 Latching Arm
16 Tooth
17 Spring
18 Pivot
19 Finger Pad

20 Standard Connector 1st End
21 Standard Connector 2nd End
22 Jack Screw
23 Wires
24 Adapter Plate
25 Slot
26 Aperture
27 Tapered Relief
28 Lead in Ramp
29 Circuit Board connector 1st end
30 Slot
31 Aperture
32 Circuit Board Contacts
33 Threaded Post Construction Reference will now be made to the drawing figures to describe the present invention in detail.

Figure 1B:
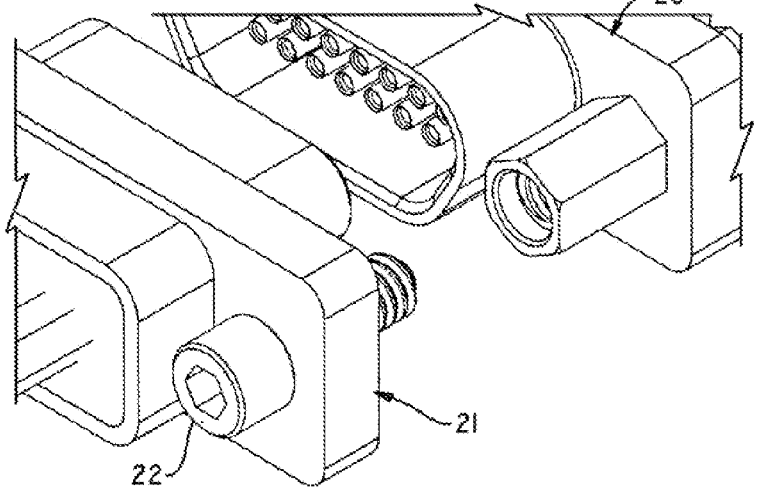
FIG. 1B PRIOR ART
FIG. 1B is a fragmentary perspective view of the prior art Micro-D type electrical connector in an open position.
Figure 1C:
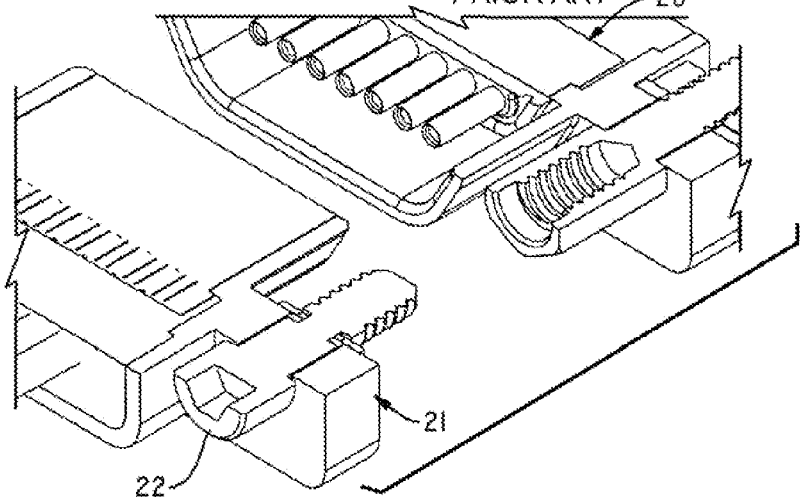
FIG. 1C PRIOR ART
FIG. 1C is a fragmentary cross-sectional view of the prior art Micro-D type electrical connector of FIG. 1B cut along the horizontal plain with the upper half thereof removed.

FIG. 1 illustrates a wire to wire prior art Micro-D type connector wire 23 with jackscrews 22 fastening the mated first connector end 20 with the second connector end 21, where FIG. 1A shows them fastened, FIG. 1B the two connector ends pulled apart, and FIG. 1C a cross-sectional view of the pulled apart connectors.

Figure 2A:
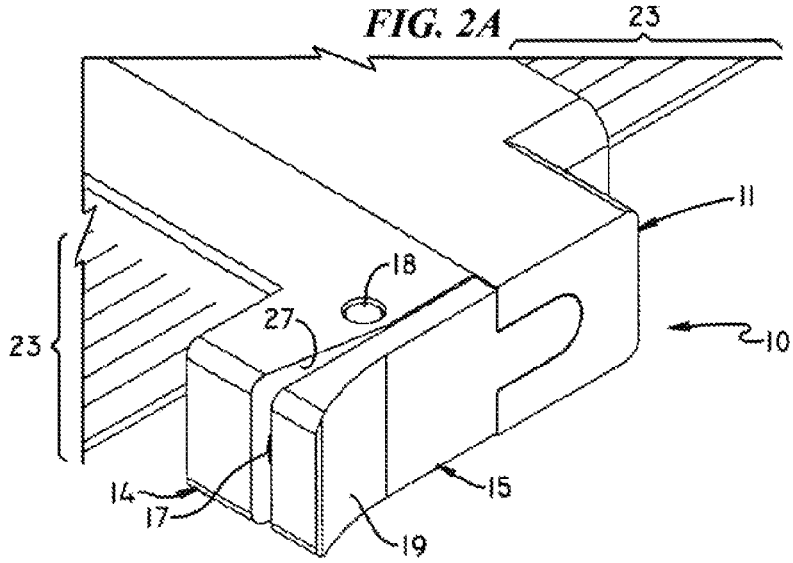
FIG. 2A is a fragmentary perspective view of the fastener of this application in a closed position.
Figure 2B:
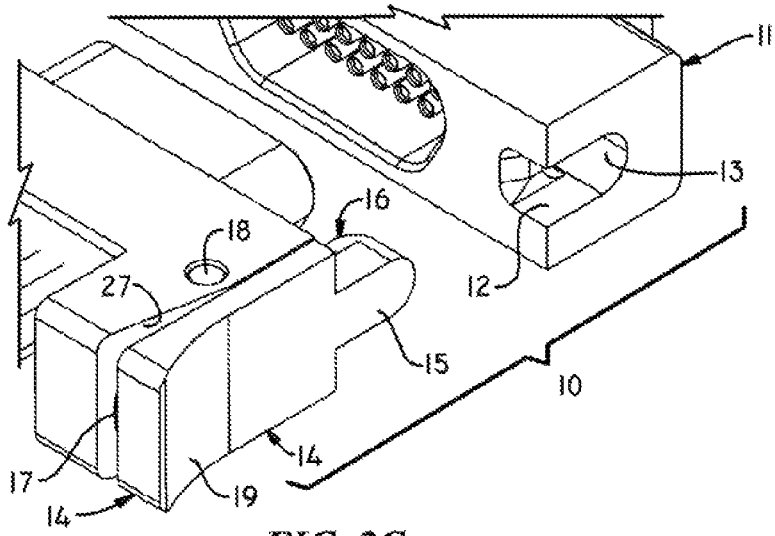
FIG. 2B is a fragmentary perspective view of the fastener of this application in an open position.

FIGS. 2 and 3 illustrate an electrical connector latching system 10 in accordance with the present invention where the screw-type fastener of the prior art is replaced with a latching arm 15 bearing a tooth 16, the tooth 16 received by a slot 12 and locked into place into an aperture 13, both slot 12 and aperture 13 are shown formed in a first end 11 of the connector pair 11 although it is understood that the slot 12 and aperture 13 could be formed into the housing of either the pin contact end or the contact receiving end of the connector 10. The slot 12 acts as a guide to the placement of the tooth 16 in the aperture 13. The tooth 16 has a lead-in ramp 28 formed as part of the tooth 16. Once the tooth 16 is received into the aperture 13, the spring 17 mounted in the second end 14, urges the latching arms 15 away from the connector second end 14, and acts to lock the tooth 16 in place, locking the two-piece connector 10 together until such time as a disconnect is desired. The finger pads 19 can be depressed to manually release the tooth 16 from the slot 12 to disconnect the two-piece connector 10. Additionally, the finger pads 19 can be depressed during mating of the two electrical connector ends 14, 11 facilitating the locking of the two connector ends 14, 11 together. Pivot 18 is provided to move the latching arms 15.

Figure 2C:
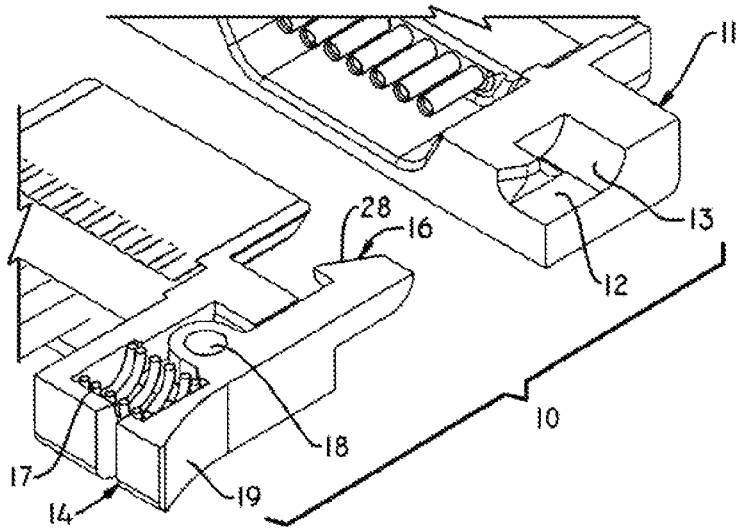
FIG. 2C is a fragmentary perspective view of the fastener of this application as shown in FIG. 2B cut along the horizontal plain with the upper half thereof removed.

FIG. 3 illustrates an adapter plate 24 having a slot 25 and aperture 26 for receiving the tooth 16 mounted on the latching arm 15. Adapter plate 24 is attached to standard connector $1^{st}$ end 20 by threaded post 33. Because a lead in ramp 28 is formed on tooth 16, as illustrated at FIG. 2C, the tooth 16 is guided by the adapter slot 25 to permit latching of the second connector end 14 to the receiving adapted connector first end 20. The adapter plate 24 permits retro-fitting of the latching system 10 to the standard Micro-D type electrical connector, FIGS. 1A-C. It is understood that the adapter plate 24, with the slot 25 and aperture 26 formed therein, could also be fastened to the housing of either the pin contact end (male) or the socket contact receiving end (female) of the connector. The slot 25 acts as a guide to the placement of the tooth 16 into the aperture 26 in the same manner as described above for FIG. 2. Once the tooth 16 is received into the aperture 26, the spring 17 acts to lock the tooth 16 in place, latching the two-piece connector 14, 20 together until such time as a disconnect of the two-piece connector is desired. Additionally, applying pressure to the finger pads 19 pivots the latching arms 15 and pair of teeth 16 out of the way such that the two piece connector 14, 20 is able to be mated together. Manually removing pressure from the finger pads 19 of the latching arms 15 permits the spring 17 to lock the tooth 16 in place, locking the two-piece connector 14, 20 together. Manually depressing the finger pads 19 of the latching arm 15 releases the tooth 16 from the aperture 26 and the connector end 14 may be removed. The tapered relief 27 of the 2nd connector end 14, shown at FIGS. 2A & B, permits the pivoting motion of the latching arms 15 about pivot.

The components of the present latching system 10 in accordance with the present invention can be formed of cast metal, metal injection molding, plastic injection molding or plastic machined parts. In actual use conditions, the components are machined metal components and hand assembled with the aid of a small arbor press. In the preferred embodiment, the electrical connector interface, including the "D" shape and contact configuration of the components are fully compliant with MIL-DTL-83513 requirements.

Use

In use, the component parts of the latching system 10 are formed and mounted on connector ends in accordance with the present invention rather than the standard Micro-D type connectors. Namely, provided is a novel connector first end 11 having slots 12 formed in two sides, each slot 12 having an aperture 13 formed in the interior end of the slot 12, the aperture 13 formed generally perpendicularly to the slot 12. The user provides a novel connector second end 14 having a pair of spring-mounted latching arms 15 on two sides, each latching arm 15 having a tooth end 16 and a finger pad end 19 formed therein. The user can slide the tooth 16 of each pair of latching arms 15 such that the tooth 16 is received and guided by the slot 12 of the receiver end 11 such that the tooth 16 pops into place in the aperture 13 urged by the spring 17. Additionally, the user can manually pivot the pair of latching arms 15 outwardly by manually depressing the finger pads 19 on each latching arm 15 and by pushing manually the two ends of the connector 11 and 14 together to mate the connector ends, each arm 15 and tooth 16 is received and guided by the slot 12 formed in the opposite connector end. Releasing manually the pair of latching arms 15 causes the spring-mounted latching arms 15, with the tooth 16 mounted thereon, to be received by the aperture 13 found in the interior end of the slot 12, latching and mating the two-piece connector together. The latching system can be reversed to disconnect the two mated connector ends 11, 14, namely, by manually depressing the finger pads 19 on each latching arm 15 to overcome the spring 17 mounted within the latching arm 15 to release the tooth 16 from the aperture 13 formed in the receiver connector end 14. The user then manually pulls apart the two ends of the connector 11, 14 to disconnect the connector ends. No tools are required. The latching system can be used in small spaces and in places where a tool cannot fit or is not practical. Also, the latching system can be used were repeated mate and un-mate cycles makes jackscrews impractical. The latching system is quickly accomplished. Misalignment of the connector ends is prevented by the slot 30 acting as a guide to the placement of the tooth 16 in the aperture 13. The aperture 13 holds the tooth 16 in place, urged by the spring 17 locking the two-piece connector 11, 14 together until such time as a disconnect, or un-mating of the two piece connector, is preferred.

Figure 4A:
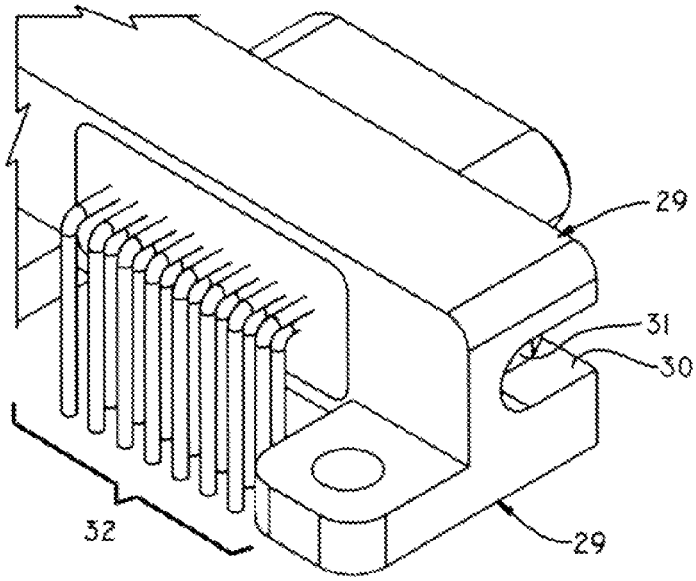
FIG. 4A is a fragmentary perspective view of the receiving end latch of this application mounted on a circuit board.
Figure 4B:
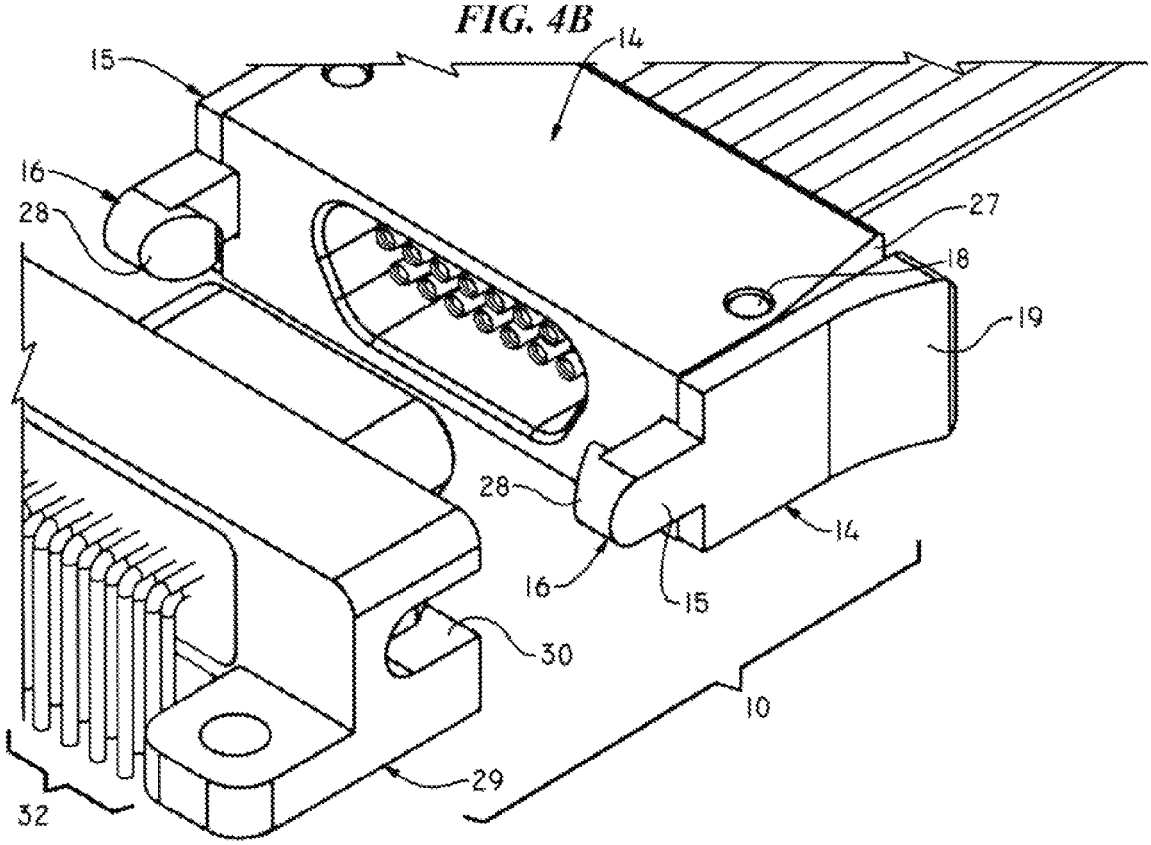
FIG. 4B is a fragmentary perspective view of the two pieces of the latching system of this application, the receiving end latch mounted on a circuit board and the pivoting arm end mounted on the end of circuitry.
Figure 4C:
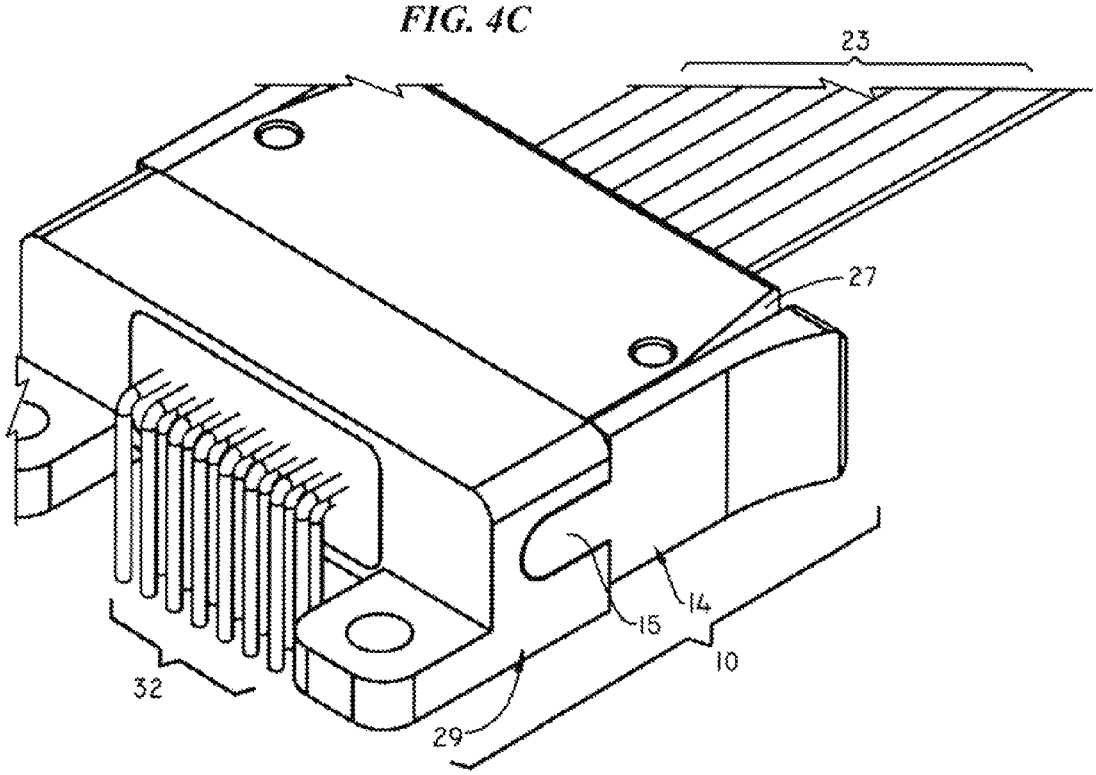
FIG. 4C is a fragmentary perspective view of the two pieces of the latching system mating together.
Figure 4D:
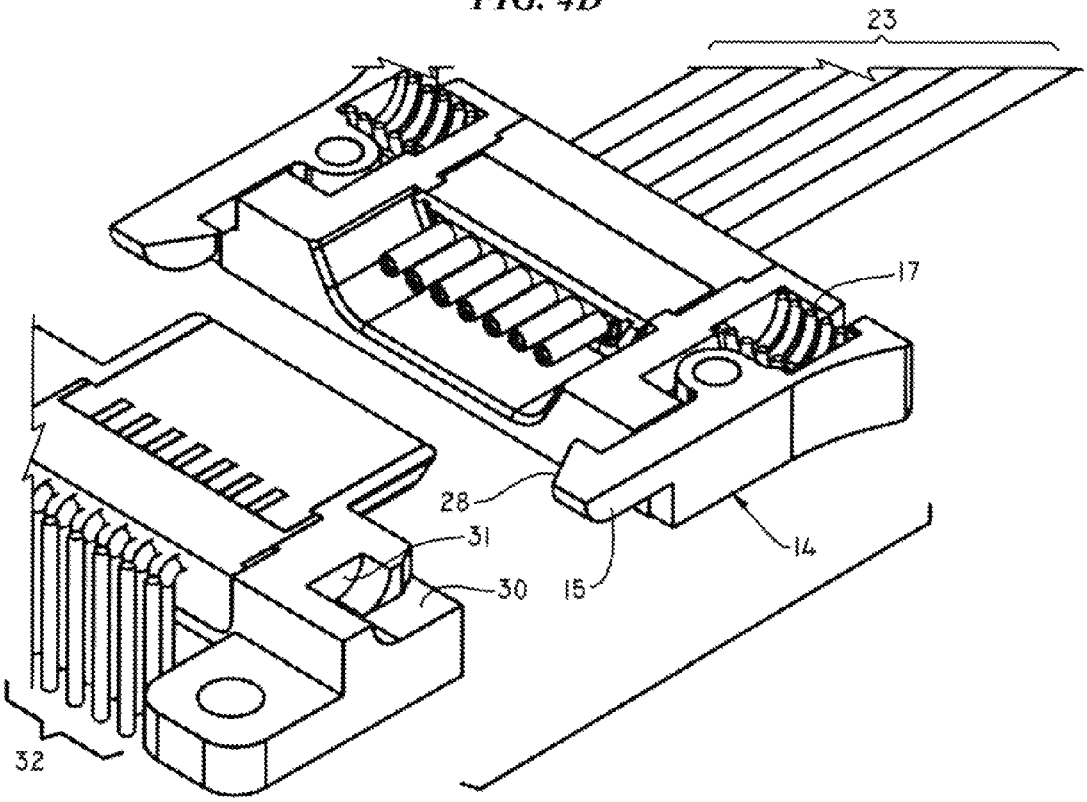
FIG. 4D is a fragmentary perspective view of the fastener of this application as shown in FIG. 4B cut along the horizontal plain with the upper half thereof removed.

FIGS. 4A-D illustrate use of the latching system as described herein in a wire to circuit board environment. FIG. 4A illustrates the novel receiver 1st connector end 29 with a slot 30 and aperture 31. The circuit board contacts are indicated generally at 32. FIG. 4B illustrates the circuit board 1st end 29 positioned to receive the latching arms 15 of the $2^{nd}$ connector end 14 in the same manner as described in the previous figures. The tooth 16 formed as part of the latching arm 15 is received by the slot 30 formed in the 1st connector end 29. The slot 30 guides the tooth 16 into position and the spring 17, shown in FIG. 4D, urges the tooth 16 into the aperture 31 latching the two piece electrical connector 14, 29 in a mated relationship to each other. Because the 2nd connector 14 body has a tapered relief 27, the latching arms 15 can move about pivot 18. Finger pad 19 is provided to enable manual pivoting of the latching arms 15, especially useful when a disconnection is desired. However, the 1st connector end 29 and the $2^{nd}$ connector end 14 can be manually pushed together with the slot 30 guiding the tooth 16 into position to be received by aperture 31 when spring 17 urges the latching arm 15, mating the two electrical connector ends together. FIG. 4C illustrates these two electrical connectors mated together. FIG. 4D is a cross-sectional view provided to enhance understanding of the invention.

Figure 3A:
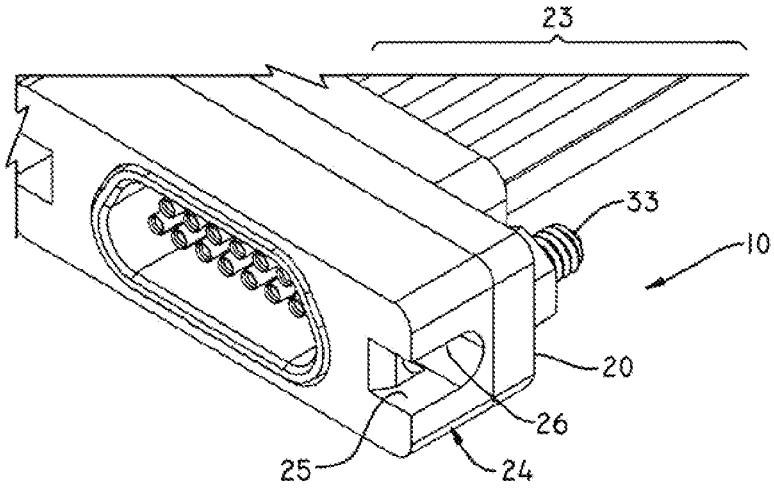
FIG. 3A is a fragmentary perspective view of the adapter plate of this application mounted on a first end of the prior art Micro-D type connector.
Figure 3B:
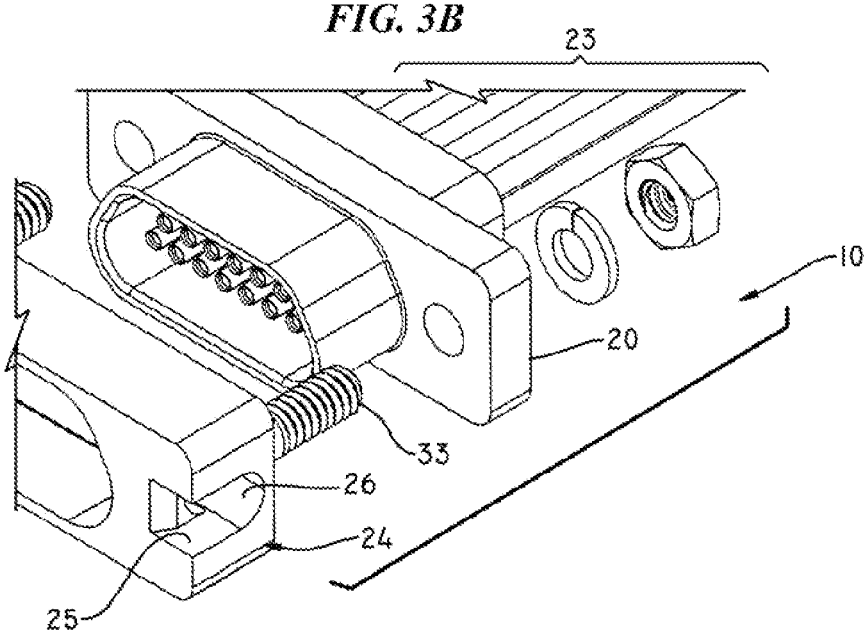
FIG. 3B is a fragmentary perspective view of the adapter plate of this application in an open position ready to be mounted on the first end of the prior art Micro-D type connector.
Figure 3C:
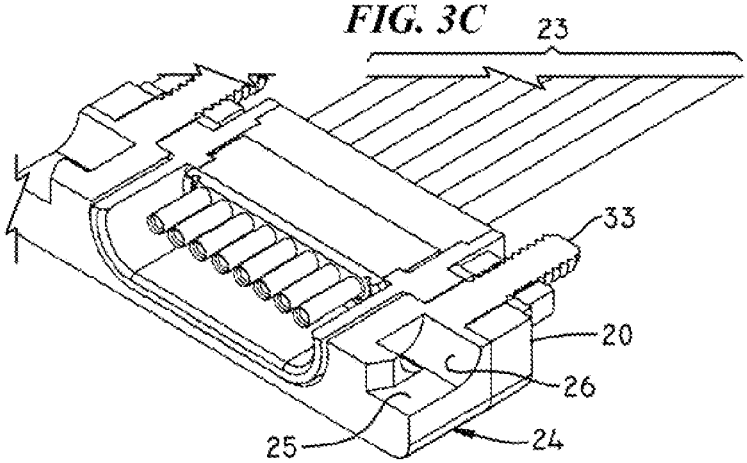
FIG. 3C is a fragmentary perspective view of the adapter plate of this application mounted on a first end of the prior art Micro-D type connector shown in FIG. 3A cut along the horizontal plain with the upper half thereof removed.

The adapter plate 24 permits retro-fitting of the latching system to the standard Micro-D type electrical connector, FIGS. 1A-C. The adapter plate 24, FIGS. 3A-C is fastened to the standard Micro-D type connector 20 using the threaded-posts 33 and nuts to fasten to the standard housing already in place, illustrated at FIGS. 3A-C. The user provides a novel connector second end 14 having a pair of spring-mounted pivoting latching arms 15 on two sides, each latching arm 15 having a tooth end 16 and a finger pad end 19 formed therein. The user pivots the pair of latching arms 15 outwardly by manually depressing the finger pads 19 on each latching arm 15 and by pushing manually the two ends of the connector 11 and 14 together to mate the connector ends, each latch arm 15 and tooth 16 is received and guided by the slot 12 formed in the opposite connector end. Releasing manually the pair of latching arms 15 causes the spring-mounted pivoting latching arms 15 with the tooth 16 mounted hereon to be received by the aperture 13 found in the interior end of the slot 12, locking and mating the two-piece connector 14, 20 together. As noted earlier, the finger pads 19 need not be depressed to mate the connectors. The latching system can be reversed to disconnect the two mated connector ends, namely, by manually depressing the finger pads 19 on each latching arm 15 to overcome the spring 17 mounted within the pivoting latching arm 15 to release the tooth 16 from the aperture 13 formed in the receiver connector end 20. The user then manually pulls the two ends of the connector 14, 20 apart to disconnect the connector ends. No tools are required.

It is understood that the adapter plate 24, with the slot 25 and aperture 26 formed therein, could also be fastened to the housing of either the pin contact end or the contact receiving end of the connector. A latching arm bearing connector can latch such a two piece connector together. The slot 25 acts as a guide to the placement of the tooth 16 in the aperture 26. Once the tooth 16 is in position, received into the aperture 26, the spring 17 urges the tooth 16 into place. Pressure on the finger pads 19 also pivots the latching arm 15 out of the way so the tooth 16 may be received by the aperture 26 and when pressure is removed from the finger pads 19 of the latching arms 15, the spring 17 acts to lock the tooth 16 in place, locking the two-piece connector together until such time as a disconnect is desired.

The device of this invention is shown with the slots 12, 25, 30 in the female socket contact receiver end; however, a reversed latch arrangement could be made where the present invention could be adapted for use with the slots 12, 25, 30 formed in the male contact pin connector end and the latching arms 15 adapted for the female socket connector end. While wired parts shown in FIGS. 2-3, the latching system is also used with circuit board mount configurations, FIG. 4, with the wired contact ends latching onto the stationary socket contact receiver mounted on a circuit board. The latching system could also be used in panel mount electrical connector.

We claim:

1. A method for tool-free latching of small sized two piece electrical connector, comprising the steps of:

(a) obtaining a standard connector first end;

(b) obtaining a connector second end having a pair of spring-mounted latch arms on two sides, each arm having a tooth end and a finger pad end formed therein;

(c) obtaining an adapter plate having, (i) a body having sides and the body is configured and arranged to attach to a pin contact end or a socket contact receiving end of the standard connector first end, (ii) a channel through the body wherein the channel is configured and arranged to accommodate passage of the pin contact end or the socket contact receiving end of the standard connector first end to allow usage of the pin contact end or socket contact receiving end, and (iii) a pair of slots formed on the sides of the body, the slots each having an aperture and an interior end of the wherein the slots are configured and arranged for receiving the tooth end mounted on the latching arm of the connector second end;

(d) attaching the adapter plate to the standard connector first end;

(e) pushing manually the two ends of the connector together to mate the connector ends such that each arm and tooth is guided by the slot formed in the adapter; and (f) urging the pair of latch arms by the spring mounted therein such that the tooth mounted on each arm is guided by the slot and received by the aperture found in the interior end of the slot mating the two-piece connector.

2. The method for tool-free latching of small sized two piece electrical connector of claim 1, wherein the standard connector first end is a Micro-D type electrical connector.

3. The method for tool-free latching of small sized two piece electrical connector of claim 1, wherein the standard connector first end is of a wire to wire environment, a wire to circuit board environment or a wire to electrical panel environment.

* * * * *